US006565457B1

(12) United States Patent
Sullivan et al.

(10) Patent No.: US 6,565,457 B1
(45) Date of Patent: May 20, 2003

(54) GOLF BALL CONTAINING HIGH DENSITY FILLERS IN THE CORE AND COVER

(75) Inventors: Michael J. Sullivan, Ludlow, MA (US); R. Dennis Nesbitt, Westfield, MA (US); John L. Nealon, Springfield, MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 441 days.

(21) Appl. No.: 09/110,221

(22) Filed: Jul. 6, 1998

Related U.S. Application Data

(60) Provisional application No. 60/054,049, filed on Jul. 14, 1997.

(51) Int. Cl.[7] ..... A63B 37/00
(52) U.S. Cl. ..... 473/378
(58) Field of Search ..... 473/372, 373, 473/378

(56) References Cited

U.S. PATENT DOCUMENTS

| | | | |
|---|---|---|---|
| 1,182,605 | A | 5/1916 | Wadsworth |
| 1,351,145 | A | 8/1920 | Worthington et al. |
| 1,482,232 | A | 1/1924 | Hazeltine |
| 1,529,708 | A | 3/1925 | Morris |
| 1,568,514 | A | 1/1926 | Lewis |
| 1,795,732 | A | 3/1931 | Miller |
| 2,050,402 | A | 8/1936 | Walsh |
| 2,741,480 | A | 4/1956 | Smith |
| 2,861,810 | A | 11/1958 | Veatch |
| 2,997,302 | A | 8/1961 | Smith |
| 3,031,194 | A | 4/1962 | Strayer |
| RE25,427 | E | 7/1963 | Harkins |
| 3,264,272 | A | 8/1966 | Rees |
| 3,331,605 | A | 7/1967 | Sperial |
| 3,819,768 | A | 6/1974 | Molitor |
| 3,865,369 | A | 2/1975 | Randolph |
| 3,940,145 | A | 2/1976 | Gentiluomo |
| 4,085,937 | A | 4/1978 | Schenk |
| 4,141,559 | A | 2/1979 | Melvin et al. |
| 4,201,384 | A | 5/1980 | Barber |
| 4,256,304 | A | 3/1981 | Smith et al. |
| 4,264,071 | A | 4/1981 | Randolph |
| 4,274,637 | A | 6/1981 | Molitor |
| 4,431,193 | A | 2/1984 | Nesbit |
| 4,483,537 | A | 11/1984 | Hanada et al. |
| 4,546,980 | A | 10/1985 | Gendreau |
| 4,625,964 | A | 12/1986 | Yamada |
| 4,650,193 | A | 3/1987 | Molitor et al. |
| 4,660,834 | A | 4/1987 | Solheim |
| 4,681,323 | A | 7/1987 | Alaki et al. |

(List continued on next page.)

FOREIGN PATENT DOCUMENTS

| | | |
|---|---|---|
| EP | 0 600 721 A1 | 8/1994 |
| GB | 2230531 | 10/1990 |
| GB | 2260546 | 5/1996 |
| WO | WO 02509 | 11/1980 |

*Primary Examiner*—Mark S. Graham
*Assistant Examiner*—Raeann Gordon

(57) ABSTRACT

The present invention is directed to improved golf ball compositions in which the balls have low spin and excellent distance. The balls contain tungsten or another high density filler in a solid, central core in order to enhance coefficient of restitution, and have very high quantities of whitening agent in the outer cover layer to increase the moment of inertia and thus reduce spin. This results in a golf ball exhibiting enhanced distance while maintaining good durability. In a preferred version of the present invention, a golf ball is provided that comprises a core and a dimpled cover disposed about the core. The core includes a rubber and 0.1 to 40 parts by weight of a filler material having a specific gravity of at least 7. The cover includes a resin and at least 2.5 parts by weight of a particular whitening agent.

20 Claims, 1 Drawing Sheet

U.S. PATENT DOCUMENTS 4,714,253 A 12/1987 Nakahara et al.
4,726,590 A 2/1988 Molitor
4,729,567 A 3/1988 Oka et al.
4,770,422 A 9/1988 Isaac
4,801,649 A 1/1989 Statz
4,804,189 A 2/1989 Gobush
4,840,381 A 6/1989 Ihara et al.
4,848,770 A 7/1989 Shama
4,852,884 A 8/1989 Sullivan
4,858,923 A 8/1989 Gobush et al.
4,863,167 A * 9/1989 Matsuki et al. ..... 473/373
4,884,814 A 12/1989 Sullivan
4,911,451 A 3/1990 Sullivan et al.
4,968,038 A 11/1990 Yamada
4,971,330 A 11/1990 Morell
4,986,545 A 1/1991 Sullivan
5,000,459 A 3/1991 Isaac
5,009,428 A 4/1991 Yamagishi et al.
5,026,067 A 6/1991 Gentiluomo
5,048,838 A 9/1991 Chikaraishi
5,098,105 A 3/1992 Sullivan
5,120,791 A 6/1992 Sullivan
5,187,013 A 2/1993 Sullivan
5,209,485 A 5/1993 Nesbitt
5,215,304 A 6/1993 Pinel, Jr. et al.
5,222,739 A 6/1993 Horiuchi et al.
5,244,969 A 9/1993 Yamada
5,273,286 A 12/1993 Sun
5,273,287 A 12/1993 Molitor et al.
5,274,041 A 12/1993 Yamada
5,298,571 A 3/1994 Statz et al.
5,304,608 A 4/1994 Yabuki et al.
5,368,304 A 11/1994 Sullivan et al.
5,439,227 A 8/1995 Egashira et al.
5,482,286 A 1/1996 Egashira et al.
5,542,680 A 8/1996 Proudfit et al.
5,580,057 A 12/1996 Sullivan et al.
5,688,869 A 11/1997 Sullivan
5,733,207 A 3/1998 Sullivan et al.
5,752,889 A * 5/1998 Yamagishi et al. ..... 473/372 X
5,785,612 A 7/1998 Shapiro et al.
5,792,009 A * 8/1998 Maruko ..... 473/373 X

* cited by examiner

GOLF BALL CONTAINING HIGH DENSITY FILLERS IN THE CORE AND COVER

This application claims the benefit of Provisional application no. 60/054,049, filed Jul. 14, 1997.

FIELD OF THE INVENTION

The present invention relates to golf balls and more particularly to golf balls containing fillers.

BACKGROUND OF THE INVENTION

Golf balls utilized in tournament or competitive play today are regulated for consistency purposes by the United States Golf Association (U.S.G.A.). In this regard, there are five (5) U.S.G.A. specifications which golf balls must meet under controlled conditions. These are size, weight, velocity, driver distance and symmetry.

Under the U.S.G.A. specifications, a golf ball can not weigh more than 1.62 ounces (with no lower limit) and must measure at least 1.68 inches (with no upper limit) in diameter. However, as a result of the openness of the upper or lower parameters in size and weight, a variety of golf balls can be made. For example, golf balls are manufactured today which by the Applicant are slightly larger (i.e., approximately 1.72 inches in diameter) while meeting the weight, velocity, distance and symmetry specifications set by the U.S.G.A.

Additionally, according to the U.S.G.A., the initial velocity of the ball must not exceed 250 ft/sec. with a 2% maximum tolerance (i.e., 255 ft/sec.) when struck at a set club head speed on a U.S.G.A. machine. Furthermore, the overall distance of the ball must not exceed 280 yards with a 6% tolerance (296.8 yards) when hit with a U.S.G.A. specified driver at 160 ft/sec. (clubhead speed) at a 10 degree launch angle as tested by the U.S.G.A. Lastly, the ball must pass the U.S.G.A. administered symmetry test, i.e., fly consistency (in distance, trajectory and time of flight) regardless of how the ball is placed on the tee.

While the U.S.G.A. regulates five (5) specifications for the purposes of maintaining golf ball consistency, alternative characteristics (i.e., spin, feel, durability, distance, sound, visibility, etc.) of the ball are constantly being improved upon by golf ball manufacturers. This is accomplished by altering the type of materials utilized and/or improving construction of the balls. For example, the proper choice of cover and core materials are important in achieving certain distance, durability and playability properties. Other important factors controlling golf ball performance include, but are not limited to, cover thickness and hardness, core stiffness (typically measured as compression), ball size and surface configuration.

As a result, a wide variety of golf balls have been designed and are available to suit an individual player's game. Moreover, improved golf balls are continually being produced by golf ball manufacturers with technologized advancements in materials and manufacturing processes.

Two of the principal properties involved in a golf ball's performance are resilience and compression. Resilience is generally defined as the ability of a strained body, by virtue of high yield strength and low elastic modulus, to recover its size and form following deformation. Simply stated, resilience is a measure of energy retained to the energy lost when the ball is impacted with the club.

In the field of golf ball production, resilience is determined by the coefficient of restitution (C.O.R.), the constant "e" which is the ratio of the relative velocity of an elastic sphere after direct impact to that before impact.

Golf balls are typically described in terms of their size, weight, composition, dimple pattern, compression, hardness, durability, spin rate, and coefficient of restitution (COR). One way to measure the COR of a golf ball is to propel the ball at a given speed against a hard massive surface, and to measure its incoming and outgoing velocity. The COR is the ratio of the outgoing velocity to the incoming velocity and is expressed as a decimal between zero and one.

There is no United States Golf Association limit on the COR of a golf ball but the initial velocity of the golf ball must not exceed 250±5 ft/second. As a result, the industry goal for initial velocity is 255 ft/ second, and the industry strives to maximize the COR without violating this limit.

The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

PGA compression is another important property involved in the performance of a golf ball. The compression of the ball can affect the playability of the ball on striking and the sound or "click" produced. Similarly, compression can effect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, PGA compression indicates the amount of change in golf ball's shape upon striking.

In the past, PGA compression related to a scale of from 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200–100) and a ball which deflects 0.110 inches (110×0.001 inches) has a PGA compression of 90 (i.e., 200–110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by OK Automation, Sinking Spring, Pa. 19608 . The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The OK Automation test apparatus consists of a lower movable platform and an upper movable spring-loaded anvil. The dial indicator is mounted such that it measures the upward movement of the springloaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilizes a modified Riehle Compression Machine originally produced by Riehle Bros. Testing Machine Company, Phil., Pa. to evaluate compression of the various components (i.e., cores, mantle cover balls, finished balls, etc.) of the golf balls. The Riehle compression device determines deformation in thousandths of an inch under a fixed initialized load of 200 pounds. The selection of an appropriate anvil for use in making a measurement is based upon the diameter of the component which is to be measured. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression=160-Riehle compression. Consequently, 80 Riehle compression corresponds to 80 PGA compression, 70 Riehle compression corresponds to 90 PGA compression, and 60 Riehle compression corresponds to 100 PGA compression. For reporting purposes, Applicant's compression values are usually measured as Riehle compression.

Furthermore, additional compression devices may also be utilized to monitor golf ball compression so long as the correlation to PGA compression is known. These devices have been designed, such as a Whitney Tester, to correlate or correspond to PGA compression through a set relationship or formula.

Additionally, cover hardness and thickness are important in producing the distance, playability and durability properties of a golf ball. As mentioned above, cover hardness directly affects the resilience and thus distance characteristics of a ball. All things being equal, harder covers produce higher resilience. This is because soft materials detract from resilience by absorbing some of the impact energy as the material is compressed on striking.

Furthermore, soft covered balls are preferred by the more skilled golfer because he or she can impact high spin rates that give him or her better control or workability of the ball. Spin rate is an important golf ball characteristic for both the skilled and unskilled golfer. As just mentioned, high spin rates allow for the more skilled golfer, such as PGA and LPGA professionals and low handicap players, to maximize control of the golf ball. This is particularly beneficial to the more skilled golfer when hitting an approach shot to a green. Thus, the more skilled golfer generally prefers a golf ball exhibiting high spin rate properties.

However, a high spin golf ball is not desired by all golfers, particularly high handicap players who cannot intentionally control the spin of the ball. Additionally, since a high spinning ball will roll substantially less than a low spinning golf ball, a high spinning ball is generally short on distance.

In this regard, less skilled golfers, have, among others, two substantial obstacles to improving their game: slicing and hooking. When a club head meets a ball, an unintentional side spin is often imparted which sends the ball off its intended course. The side spin reduces one's control over the ball as well as the distance the ball will travel. As a result, unwanted strokes are added to the game.

Consequently, while the more skilled golfer frequently desires a high spin golf ball, a more efficient ball for the less skilled player is a golf ball that exhibits low spin properties. The low spin ball reduces slicing and hooking and enhances distance. Furthermore, since a high spinning ball is generally short on distance, such a ball is not universally desired by even the more skilled golfer.

With respect to high spinning balls, up to approximately twenty years ago, most high spinning balls were comprised of balata or blends of balata with elastomeric or plastic materials. The traditional balata covers are relatively soft and flexible. Upon impact, the soft balata covers compress against the surface of the club producing high spin. Consequently, the soft and flexible balata covers provide an experienced golfer with the ability to apply side spin to control the ball in flight in order to produce a draw or a fade, or a backspin which causes the ball to "bite" or stop abruptly on contact with the green.

Moreover, the soft balata covers produce a soft "feel" to the low handicap player. Such playability properties (workability, feel, etc.) are particularly important in short iron play with low swing speeds and are exploited significantly by relatively skilled players.

However, despite all the benefits of balata, balata covered golf balls are easily cut and/or damaged if mis-hit. Golf balls produced with balata or balata-containing cover compositions therefore have a relatively short lifespan.

Additionally, soft balata covered balls are shorter in distance. While the softer materials will produce additional spin, this is frequently produced at the expense of the initial velocity of the ball. Moreover, as mentioned above, higher spinning balls tend to roll less.

As a result of these negative properties, balata and its synthetic substitutes, transpolyisoprene and transpolybutadiene, have been essentially replaced as the cover materials of choice by new synthetic materials. Included in this group of materials are ionomer resins.

Ionomeric resins are polymers in which the molecular chains are cross-linked by ionic bonds. As a result of their toughness, durability and flight characteristics, various ionomeric resins sold by E.I. DuPont de Nemours & Company under the trademark "Surlyn®" and more recently, by the Exxon Corporation (see U.S. Pat. No. 4,911,451) under the trademarks "Escor®" and "lotek®", have become the materials of choice for the construction of golf ball covers over the traditional "balata" (transpolyisoprene, natural or synthetic) rubbers. As stated, the softer balata covers, although exhibiting enhanced playability properties, lack the durability (cut and abrasion resistance, fatigue endurance, etc.) properties required for repetitive play and are limited in distance.

Ionomeric resins are generally ionic copolymers of an olefin, such as ethylene, and a metal salt of an unsaturated carboxylic acid, such as acrylic acid, methacrylic acid, or maleic acid. Metal ions, such as sodium or zinc, are used to neutralize some portion of the acidic group in the copolymer resulting in a thermoplastic elastomer exhibiting enhanced properties, i.e., durability, etc., for golf ball cover construction over balata.

Historically, some of the advantages produced by ionomer resins in increased durability were offset to some degree by decreases produced in playability. This was because although the ionomeric resins were very durable, they initially tended to be very hard when utilized for golf ball cover construction, and thus lacked the degree of softness required to impart the spin necessary to control the ball in flight. Since the initial ionomeric resins were harder than balata, the ionomeric resin covers did not compress as much against the face of the club upon impact, thereby producing less spin.

In addition, the initial, harder and more durable ionomeric resins lacked the "feel" characteristic associated with the softer balata related covers. The ionomer resins tended to produce a hard responsive "feel" when struck with a golf club such as a wood, iron, wedge or putter.

As a result of these difficulties and others, a great deal of research has been and is currently being conducted by golf ball manufacturers in the field of ionomer resin technology. There are currently more than fifty (50) commercial grades of ionomers available both from DuPont and Exxon, with a wide range of properties which vary according to the type and amount of metal cations, molecular weight, composition of the base resin (i.e., relative content of ethylene and methacrylic and/or acrylic acid groups) and additive ingredients such as reinforcement agents, etc. However, a great deal of research continues in order to develop golf ball cover compositions exhibiting not only the improved impact resistance and carrying distance properties produced by the "hard" ionomeric resins, but also the playability (i.e., "spin", "feel", etc.) characteristics previously associated with the "soft" balata covers, properties which are still desired by the more skilled golfer.

Consequently, a number of two-piece (a solid resilient center or core with a molded cover) and three-piece (a liquid or solid center, elastomeric winding about the center, and a molded cover) golf balls have been produced by the Applicant and others to address these needs. The different types of materials utilized to formulate the cores, covers, etc. of these balls dramatically alters the balls' overall characteristics.

One of the ways to affect spin of a golf ball is to transfer weight toward or away from the center of the ball. A golf ball with increased perimeter weighting has an increased moment of inertia and/or a greater radius of gyration and thus generates lower initial spin than a golf ball with increased weighting of the center or core. A ball with increased perimeter weighting also has greater spin retention than a ball with conventional weighting. The present invention is directed to a high moment of inertia golf ball which has a relatively low spin rate.

SUMMARY OF THE INVENTION

An object of the invention is to provide a low spin golf ball with a high COR.

Another object of the invention is to provide a golf ball which will travel a long distance.

A further object of the invention is to provide a method of making a low spin golf ball.

Other objects will be in part obvious and in part pointed out more in detail hereafter.

The invention in a preferred form is a golf ball comprising a solid core formed from a rubber material and 0.1–40 parts by weight of a filler material having a specific gravity of at least 7 based upon 100 parts by weight of the rubber material, and a dimpled cover layer comprising an ionomeric resin and at least 2.5 parts by weight of a whitening agent selected from the group consisting of titanium dioxide, barium sulfite, and zinc sulfide white based upon 100 parts by weight of the resin, the golf ball having a coefficient of restitution of at least 0.750. The core of the golf ball preferably has 1–4 volume percent, and more preferably 1–2.5 volume percent more rubber than a core which contains zinc oxide filler in place of the high specific gravity filler and has the same weight and Riehle compression.

In a particularly preferred form of the invention, the filler material is tungsten. The whitening agent most preferably is titanium dioxide. The whitening agent preferably is present in an amount of 5–10 parts by weight based upon 100 parts by weight of the resin. The dimpled cover layer preferably comprises ionomer.

The solid core can have a cover layer formed directly thereon or can be surrounded by a layer of windings. An inner cover layer can be included beneath the dimpled cover layer.

Another preferred form of the invention is a golf ball comprising a solid core formed from a rubber material and 0.1–40 parts by weight of tungsten based upon 100 parts by weight of the rubber material, and a dimpled cover layer comprising an ionomeric resin and at least 2.5 parts by weight of titanium dioxide based upon 100 parts by weight of the resin. The resin used to form the golf ball cover preferably comprises ionomer. The golf ball preferably has a coefficient of restitution of at least 0.750.

Yet another preferred form of the invention is a golf ball comprising a solid core comprising a rubber material and 10–30 parts by weight of at least one member selected from the group consisting of tungsten, bismuth, and molybdenum based upon 100 parts by weight of the rubber material, and a dimpled cover layer comprising a resin composition which includes ionomer and 2.5–20 parts by weight of titanium dioxide based upon 100 parts by weight of the resin composition.

BRIEF DESCRIPTION OF THE INVENTION

DETAILED DESCRIPTION OF THE DRAWINGS

The moment of inertia of a golf ball (also known as rotational inertia) is the sum of the products formed by multiplying the mass (or sometimes the area) of each element of a figure by the square of its distance from a specified line such as the center of a golf ball. This property is directly related to the radius of gyration of a golf ball which is the square root of the ratio of the moment of inertia of a golf ball about a given axis to its mass. It has been found that the greater the moment of inertia (or the farther the radius of gyration is from the center of the ball) the lower the initial spin rate is of the ball.

The present invention is directed, in part, to increasing the moment of inertia of two-layered and multi-layered golf balls by varying the weight arrangement of the cover and the core components. By varying the weight, size and density of the components of the golf ball, the moment of inertia of a golf ball can be increased. Such a change can occur in a multi-layered golf ball, including a ball containing one or more cover layers and/or a layer of windings, to enhance distance due to the production of less side spin and improved roll.

Accordingly, the present invention is directed to an improved golf ball exhibiting enhanced distance (i.e., improved resilience, less side spin, improved roll) without adversely affecting, and in many instances, improving the ball's abrasion and scuff resistance characteristics.

Figure 1:
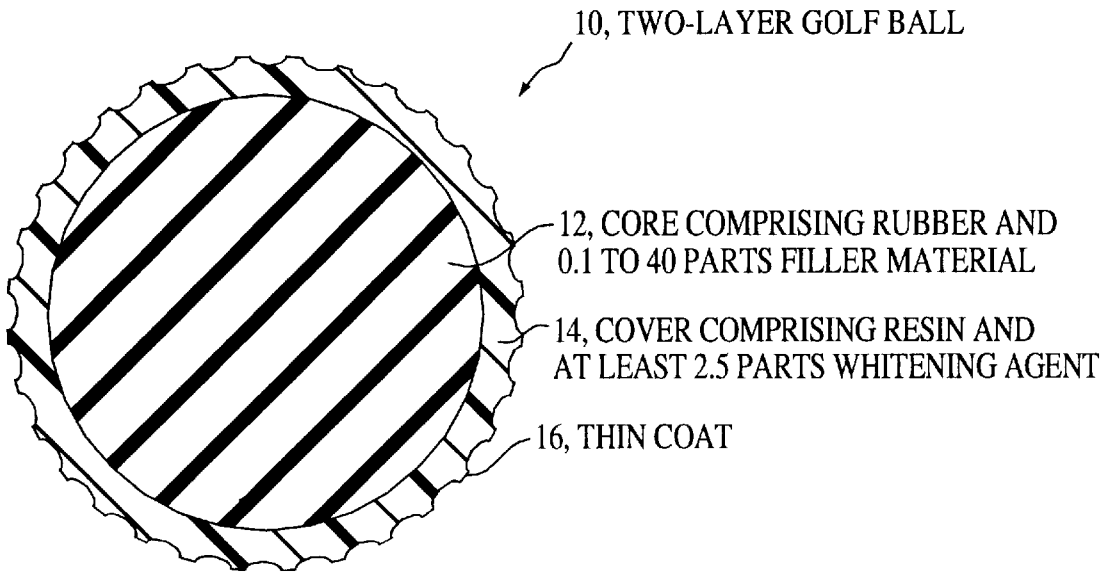
FIG. 1 shows a preferred embodiment of a two-layer golf ball according to the present invention.

Referring now to the Figures and first to FIG. 1, a two-layer golf ball is shown and is designated as 10. The golf ball includes a solid central core 12 and a dimpled cover 14 formed over the core 12. A thin polyurethane coat 16 which may consist of more than one layer is formed over the cover 14.

The core 12 contains polybutadiene rubber and 0.1–40 parts by weight of tungsten or another heavy particulate material. As a result of the use of a high-density material, such as tungsten, only a very small volume needs to be added. Thus, this golf ball core 12 has a particularly high polybutadiene content. In contrast, prior known cores typically contain 5–30 parts by weight of zinc oxide and/or 0–30 parts by weight of calcium carbonate fillers or other heavy fillers such as barium sulfate (e.g. barytes). When at least a portion of the zinc oxide and calcium carbonate is replaced by tungsten, further quantities of rubber are added to result in the same volume of core material.

The inventors have surprisingly found that the use of tungsten in place of at least a portion of the zinc oxide and calcium carbonate results in an increase of coefficient of restitution for the ball at a given core PGA compression. For example, when a core has a PGA compression of 30–100, the use of 20.0 parts by weight of tungsten and additional polybutadiene rubber material results in an increase in COR of ten points as compared to a golf ball formed from a core which contains 5–30 parts by weight of zinc oxide and/or 0–30 parts by weight of calcium carbonate. The inclusion on tungsten in the core can result in an increase in the amount of rubber in an equal volume core in a amount on the order of 1–4 volume percent at the same weight and Riehle compression.

The cover 14 of the golf ball preferably comprises ionomer, and may also include a number of other materials, including but not limited to polyurethane polyester, polyether amide, polyamide, styrene butadiene styrene, SBES, olefins and blends thereof. The cover is different from prior known covers in that it contains a very high quantity of whitener which serves the dual function of both providing the cover with excellent whiteness and providing outer perimeter weighting to the ball. While golf balls typically contain 0.3–2.3 parts by weight of titanium dioxide in the outer cover layer, the golf balls of the present invention contain at least 2.5 parts by weight of whitener based upon 100 parts by weight of resin composition, more preferably 3.5–10 parts by weight of whitening agent, and most preferably 2.5–5.0 parts by weight of whitening agent. The whitening agent preferably includes at least one member selected from the group consisting of titanium dioxide, barium sulfite, and zinc sulfide white. The use of this quantity of whitening agent results in an increase of 0.15 grams to the cover of the ball. As a result, the core of the ball has a weight reduction of roughly the same amount, i.e., 0.15 grams.

Figure 2:
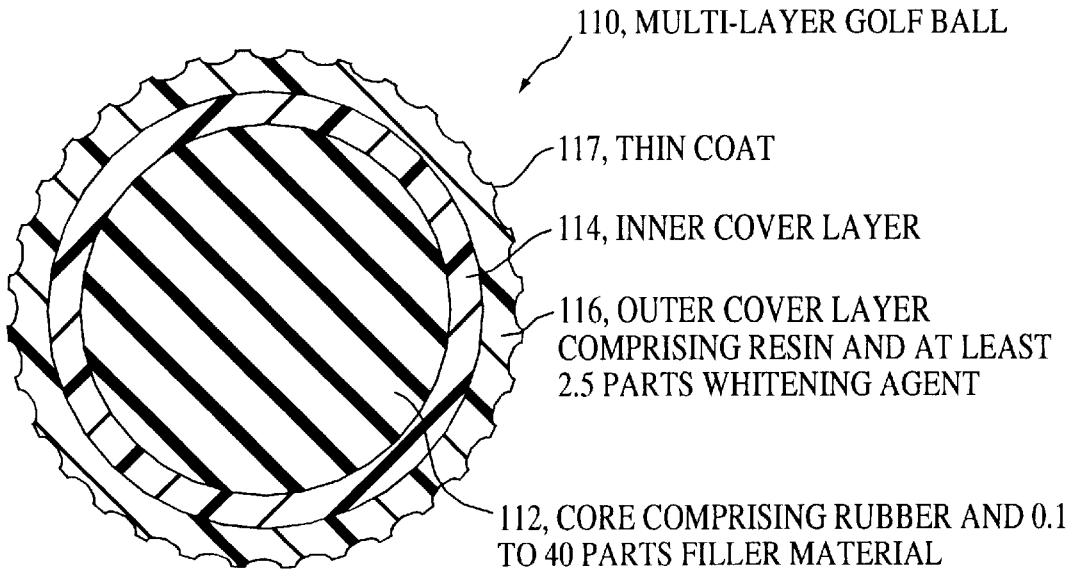
FIG. 2 shows a preferred embodiment of a multi-layer, non-wound golf ball according to a preferred embodiment of the invention.

Referring now to FIG. 2, a multi-layer, non-wound golf ball according to the invention is shown and is designated as 110. The golf ball includes a solid central core 112, an inner cover layer 114, and a dimpled outer cover layer 116. A thin polyurethane coat 117 which may consist of more than one layer is formed over the outer cover layer 116.

The core 114 can be generally identical to core 14 of the embodiment shown in FIG. 1 except the diameter is usually less. The inner cover layer 114 preferably comprises ionomer, and more preferably comprises high acid ionomers such as 35–50 wt. % lotek 1002 and 50–65 wt. % lotek 1003. The outer cover layer 116 is similar to cover 14 of the FIG. 1 embodiment in that it can be formed form the same cover materials as cover 14 and in that it contains at least 2.5 parts by weight of whitening agent based upon 100 parts by weight of resin. This results in a weight transfer from the core or inner cover layer to the outer cover layer, thereby increasing the moment of inertia of the ball.

In a particularly preferred form of a two layer ball, the core has a diameter of 1.52–1.57 in., and the cover has a thickness of 0.06–0.07 in. In a particularly preferred multi-layer embodiment such as that shown in FIG. 2, the core has a diameter of 1.54–1.58 in., the inner cover layer has a thickness of 0.04 to 0.08 in., and the outer cover layer 116 has a thickness of 0.04–0.07 in.

Additional materials may be added to the cover compositions (both inner and outer cover layer) of the present invention including dyes (for example, Ultramarine Blue sold by Whitaker, Clark and Daniels of South Plainsfield, N.J.) (see U.S. Pat. No. 4,679,795); pigments such as zinc oxide, and UV absorbers; antioxidants; antistatic agents; and stabilizers. Further, the cover compositions of the present invention may also contain softening agents, such as plasticizers, processing aids, etc., as long as the desired properties produced by the golf ball covers are not impaired.

The specially produced solid core compositions and resulting non-wound or wound centers according to the present invention are manufactured using relatively conventional techniques. In this regard, the core compositions of the invention may be based on polybutadiene, and mixtures of polybutadiene with other elastomers. It is preferred that the base elastomer have a relatively high molecular weight. The broad range for the molecular weight of suitable base elastomers is from about 50,000 to 500,000. A more preferred range for the molecular weight of the base elastomer is from about 100,000 to about 500,000. As a base elastomer for the core composition, cis-polybutadiene is preferably employed, or a blend of cis-polybutadiene with other elastomers may also be utilized. Most preferably, cis-polybutadiene having a weight-average molecular weight of from about 100,000 to about 500,000 is employed. Along this line, it has been found that the high cis-polybutadiene manufactured and sold by Shell Chemical Co., Houston, Tex., under the tradename Cariflex BR-1220 and the high cis-polybutadiene sold by Bayer Corp. under the designation Taktene 220 are suitable for use as preferred cis-polybutadienes.

The unsaturated carboxylic acid component of the core composition (a co-crosslinking agent) is the reaction product of the selected carboxylic acid or acids an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid sorbic acid, and the like, and mixtures thereof. Preferably, the acid component is either acrylic or methacrylic acid. Usually, from about 15 to about 25, and preferably from about 17 to about 21 parts by weight of the carboxylic acid salt, such as zinc diacrylate, is included in the core composition. The unsaturated carboxylic acids and metal salts thereof are generally soluble in the elastomeric base, or are readily dispersible.

The heavyweight filler in the core has a specific gravity of 7 or more. Preferred fillers include the following:

| material | spec. grav. |
|---|---|
| tungsten | 19.35 |
| bismuth | 9.78 |
| nickel | 8.90 |
| molybdenum | 10.2 |
| iron | 7.86 |
| copper | 8.94 |
| brass | 8.2–8.4 |
| bronze | 8.70–8.74 |
| cobalt | 8.92 |
| tin | 7.31 |
| zinc | 7.14 |

The filler is present in an amount of 0.1–40 parts by weight and more preferably 10–30 parts by weight based upon 100 parts by weight of rubber material.

The free radical initiator included in the core composition is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Exemplary of suitable peroxides for the purposes of the present invention are dicumyl peroxide; n-butyl 4,4'-bis (butylperoxy) valerate; 1,1-bis(t-butylperoxy)-3,3,5-trimethyl cylcohexane; di-t-butyl peroxide; 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercially available peroxides are Luperco 230 or 231 XL sold by Atochem, Lucidol Division, Buffalo, N.Y., and Trigonox 17/40 or 29/40 sold by Akzo Chemie America, Chicago, Ill. In this regard Luperco 230

XL and Trigonox 17/40 are comprised of n-butyl 4,4-bis (butylperoxy) valerate; and, Luperco 231 XL and Trigonox 29/40 are comprised of 1,1-bis(t-butylperoxy)-3,3,5-trimethyl cyclohexane. The one hour half life of Trigonox 29/40 is about 129° C.

The core compositions of the present invention may additionally contain any other suitable and compatible modifying ingredients including, but not limited to, metal oxides, fatty acids, and diisocyanates and polypropylene powder resin. For example, Papi 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger. In addition, it has been found that the addition of a polypropylene powder resin results in a core which is too hard (i.e., exhibits low compression) and thus allows for a reduction in the amount of crosslinking agent utilized to soften the core to a normal or below normal compression.

Furthermore, because polypropylene powder resin can be added to core composition without an increase in weight of the molded core upon curing, the addition of the polypropylene powder allows for the addition of higher specific gravity fillers (if desired), such as mineral fillers. Since the crosslinking agents utilized in the polybutadiene core compositions are expensive and/or the higher specific gravity fillers are relatively inexpensive, the addition of the polypropylene powder resin substantially lowers the cost of the golf ball cores while maintaining, or lowering, weight and compression.

The polypropylene ($C_3H_5$) powder suitable for use in the present invention has a specific gravity of about 0.90 g/cm$^3$, a melt flow rate of about 4 to about 12 and a particle size distribution of greater than 99% through a 20 mesh screen. Examples of such polypropylene powder resins include those sold by the Amoco Chemical Co., Chicago, Ill., under the designations "6400 P", "7000 P" and "7200 P". Generally, from 0 to about 25 parts by weight polypropylene powder per each 100 parts of elastomer are included in the present invention.

Various activators may also be included in the compositions of the present invention. For example, zinc oxide and/or magnesium oxide are activators for the polybutadiene. The activator can range from about 2 to about 50 parts by weight per 100 parts by weight of the rubbers (phr) component. The amount of activation utilized can be reduced in order to lighten the weight of the core.

Moreover, reinforcement agents may be added to the composition of the present invention. As noted above, the specific gravity of polypropylene powder is very low, and when compounded, the polypropylene powder produces a lighter molded core. Further, when a lesser amount of activation is used, the core is also lighter. As a result, if necessary, higher gravity fillers may be added to the core composition so long as the specific core weight limitations are met. The amount of additional filler included in the core composition is primarily dictated by weight restrictions and preferably is included in amounts of from about 0 to about 100 parts by weight per 100 parts rubber.

Exemplary fillers include mineral fillers such as limestone, silica, mica, barytes, calcium carbonate, or clays. Limestone is ground calcium/magnesium carbonate and is used because it is an inexpensive, heavy filler.

As indicated, ground flash filler may be incorporated and is preferably 20 mesh ground up center stock from the excess flash from compression molding. It lowers the cost and may increase the hardness of the ball.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts from about 1 to about 25, preferably in amounts from about 2 to about 15 parts by weight based on 100 parts rubber (elastomer).

Diisocyanates may also be optionally included in the core compositions when utilized, the diisocyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference.

The core compositions of the invention are generally comprised of 100 parts by weight of a base elastomer (or rubber) selected from polybutadiene and mixtures of polybutadiene with other elastomers, 10 to 40 parts by weight of at least one metallic salt of an unsaturated carboxylic acid, 0.1–40 parts by weight of a filler material having a specific gravity of at least 7, and 0.1 to 10 parts by weight of a free radical initiator.

As indicated above, additional suitable and compatible modifying agents such as particulate polypropylene resin, fatty acids, and secondary additives such as Pecan shell flour, ground flash (i.e., grindings from previously manufactured cores of substantially identical construction), barium sulfate, zinc oxide, etc. may be added to the core compositions to adjust the weight of the ball as necessary in order to have the finished molded ball (core, cover and coatings) to closely approach the U.S.G.A. weight limit of 1.620 ounces.

In producing golf ball cores utilizing the present compositions, the ingredients may be intimately mixed using, for example, two roll mills or a Banbury® mixer until the composition is uniform, usually over a period of from about 5 to about 20 minutes. The sequence of addition of components is not critical. A preferred blending sequence is as follows.

The elastomer, polypropylene powder resin (if desired), fillers, zinc salt, metal oxide, fatty acid, and the metallic dithiocarbamate (if desired), surfactant (if desired), and tin difatty acid (if desired), are blended for about 7 minutes in an internal mixer such as a Banbury® mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell preformer and slugs are produced. The slugs are then subjected to compression molding at about 320° F. for about 14 minutes. After molding, the molded cores are cooled, the cooling effected at room temperature for about 4 hours or in cold water for about one hour. The molded cores are subjected to a centerless grinding operation whereby a thin layer of the molded core is removed to produce a round core having a diameter of 1.3 to 1.7 inches (preferably about 1.45 to about 1.60 inches and most preferably, 1.52 to 1.57 inches) for a two-piece ball. Alternatively, the cores are used in the as-molded state with no grinding needed to achieve roundness.

The mixing is desirably conducted in such a manner that the composition does not reach incipient polymerization temperatures during the blending of the various components.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. The composition can be formed into a core structure by any one of a variety of molding techniques, e.g. injection, compression, or transfer molding. When the composition is cured by heating, the time required for heating will normally be short, generally from about 10 to about 20 minutes, depending upon the particular curing agent used. Those of ordinary skill in the art relating to free radical curing agents for polymers are conversant with adjustments of cure times and temperatures required to effect optimum results with any specific free radical agent.

After molding, the core is removed from the mold and the surface thereof, preferably treated to facilitate adhesion thereof to the covering materials. Surface treatment can be effected by any of the several techniques known in the art, such as corona discharge, ozone treatment, sand blasting, brush tumbling and the like. Preferably, surface treatment is effected by grinding with an abrasive wheel.

The various cover composition layers of the present invention may be produced according to conventional melt blending procedures. In the case of the outer cover layer, when a blend of hard and soft, low acid ionomer resins are utilized, the hard ionomer resins are blended with the soft ionomeric resins and with a masterbatch containing the desired additives in a Banbury® mixer, two-roll mill, or extruder prior to molding. The blended composition is then formed into slabs and maintained in such a state until molding is desired. Alternatively, a simple dry blend of the pelletized or granulated resins and color masterbatch may be prepared and fed directly into the injection molding machine where homogenization occurs in the mixing section of the barrel prior to injection into the mold. If necessary, further additives, may be added and uniformly mixed before initiation of the molding process. A similar process is utilized to formulate the ionomer resin compositions used to produce the inner cover layer.

The golf balls of the present invention can be produced by molding processes currently well known in the golf ball art. Specifically, the golf balls can be produced by injection molding or compression molding the relatively thick inner cover layer about solid molded cores or wound centers with a solid central core to produce an intermediate golf ball having a diameter of about 1.3 to 1.7 inches. The outer layer (preferably 0.015 inches to 0.110 inches in thickness) is subsequently molded over the inner layer to produce a golf ball having a diameter of 1.680 inches or more.

In compression molding, the inner cover composition is formed via injection at about 380° F. to about 450° F. into smooth surfaced hemispherical shells which are then positioned around the core in a mold having the desired inner cover thickness and subjected to compression molding at 200° to 300° F. for about 2 to 10 minutes, followed by cooling at 50° to 70° F. for about 2 to 7 minutes to fuse the shells together to form a unitary intermediate ball. In addition, the intermediate balls may be produced by injection molding wherein the inner cover layer is injected directly around the core placed at the center of an intermediate ball mold for a period of time in a mold temperature of from 50° F. to about 100° F. Subsequently, the outer cover layer is molded about the core and the inner layer by similar compression or injection molding techniques to form a dimpled golf ball of a diameter of 1.680 inches or more.

After molding, the golf balls produced may undergo various further processing steps such as buffing, painting and marking as disclosed in U.S. Pat. No. 4,911,451.

The finished golf ball of the present invention possesses the following general features:

Two-layer Ball

A. Core (Preferably a Solid Core)

1. Weight, from about 30 to 42 grams, preferably, 35 to 38.5 grams, most preferably 35 to 37 grams.
2. Size (diameter), 1.3 to 1.7 inches, more preferably from about 1.45 to 1.60 inches, most preferably 1.52 to 1.57 inches.
3. Specific gravity, from about 1.02 to 1.25, preferably 1.10 to 1.22, most preferably 1.15–1.20.
4. Compression (Riehle), from about 50 to about 150, preferably 70 to 120, most preferably 85–95.
5. Coefficient of Restitution (C.O.R.), from about 0.750 to about 0.820, preferably 0.760 to 0.805, most preferably 0.770 to 0.790.

B. Cover Layer and Core

1. Weight, from about 44.0 to 45.9 grams, preferably, 44.8 to 45.7 grams, most preferably 45.4 to 45.6 grams.
2. Size (diameter), from about 1.68 to 1.80 inches, preferably, 1.68 to 1.74 inches, most preferably 1.68 to 1.72 inches.
3. Cover Thickness (outer cover layer), from about 0.03 to about 0.20 inches, preferably 0.05 to 0.10 inches, most preferably 0.06 to 0.07 inches.
4. Compression (Riehle), from about 50 to about 120, preferably 60 to 100, most preferably 70 to 80.
5. Coefficient of Restitution (C.O.R.), from about 0.750 to about 0.820, preferably 0.780 to 0.817, most preferably 0.805 to 0.812.
6. Shore C/D Cover Hardness, from about 45/30 to about 97/72, preferably Shore D 65–75, most preferably Shore D 69–72.
7. Moment of Inertia, from about 0.4 to about 0.5, preferably 0.42 to 0.48, most preferably 0.45–0.47.

Multi-layer Ball

A. Core (Preferably a Solid Core)

1. Weight, from about 30 to 42 grams, preferably, 35 to 38.5 grams, most preferably 35–37 grams.
2. Size (diameter), from about 1.3 to 1.6 inches, preferably, 1.35 to 1.58 inches, most preferably 1.54 to 1.58 inches.
3. Specific gravity, from about 1.10–1.30, preferably 1.13 to 1.26, most preferably 1.16–1.22.
4. Compression (Riehle), from about 60 to about 160, preferably 80 to 130, most preferably 90 to 120.

B. Inner Cover Layer (Mantle) and Core

1. Weight, from about 26 to 43 grams, preferably, 29 to 40 grams, most preferably 36–40 grams.
2. Size (diameter), from about 1.38 to 1.68 inches, preferably, 1.50 to 1.67 inches, most preferably 1.55–1.59 inches.

3. Thickness of inner cover layer, from about 0.01 to about 0.20 inches, preferably 0.025 to 0.125 inches, most preferably 0.04–0.08 inches.
4. Specific gravity (inner cover layer only), from about 0.96 to 1.8, preferably 1.0 to 1.3, most preferably 1.05.
5. Compression (Riehle), from about 55 to about 155, preferably 75 to 125, most preferably 85–115.
6. Shore C/D Inner Cover Hardness, from about 87/60 to about >100/100, preferably 92/65 to >100/85, most preferably Shore D 69–72.

C. Outer Cover Layer, Inner Cover Layer and Core

1. Weight, from about 44.0 to 45.9 grams, preferably, 44.8 to 45.7 grams, most preferably 45.5 grams.
2. Size (diameter), from about 1.680 to 1.80 inches, preferably, 1.680 to 1.740 inches, most preferably 1.68–1.72 inches.
3. Cover Thickness (outer cover layer), from about 0.02 to about 0.20 inches, preferably 0.025 to 0.100, most preferably 0.04–0.07 inches.
4. Compression (Riehle), from about 59 to about 160, preferably 80 to 96, most preferably 76 to 85.
5. Coefficient of Restitution (C.O.R.), from about 0.750 to about 0.830, preferably 0.770 to 0.810, most preferably 0.780 to 0.810.
6. Shore C/D Outer Cover Hardness, from about 35-20/92-65 to about 40/25 to 90/60, more preferably Shore D 54–58.
7. Moment of Inertia, from about 0.390 to about 0.480, preferably 0.430 to 0.460, most preferably 0.44 to 0.45.

As used herein, the terms "Shore D hardness" and "Shore C hardness" are measurements of golf ball cover hardness taken generally in accordance with ASTM D-2240, with the exception that all measurements are made on the curved surface of the cover of a ball, rather than on a flat sample of cover material in the form of a flat plaque. In these measurements, the golf ball is completely intact with the cover in place surrounding the core. To make the measurement of Shore hardness as uniform as possible, the measurements are taken at "land" areas of a dimpled golf ball cover, i.e., on portions of the cover between the dimples.

The present invention is further illustrated by the following examples in which the parts of the specific ingredients are by weight. It is to be understood that the present invention is not limited to the examples, and various changes and modifications may be made in the invention without departing from the spirit and scope thereof.

EXAMPLE 1

A number of golf ball cores were made incorporating tungsten, bismuth or molybdenum fillers, which are all high specific gravity materials. Furthermore, a set of control cores was made using zinc oxide. Tungsten has a specific gravity of 19.35, bismuth has a specific gravity of 9.78, molybdenum has a specific gravity of 10.2, and zinc oxide has a specific gravity of 5.57. The core formulations are shown below on Table 1.

To estimate the relative distance each of the balls would travel if they were covered with the same type of cover, the Riehle compression and coefficient of restitution (×1000) were added together. The highest number is believed to represent the longest ball. The tungsten-containing core is therefore believed to be the longest, followed by the bismuth-containing core, the molybdenum-containing core, and, lastly, the zinc oxide-containing core. Thus, it appears that by replacing a portion of the zinc oxide filler with a higher specific gravity filler, a more efficient golf ball center can be formed.

TABLE 1

Filled Golf Ball Cores

| | 1-1 | 1-2 | 1-3 | 1-4 |
|---|---|---|---|---|
| Cariflex BD-1220 | 70 | 70 | 70 | 70 |
| Taktene 220 | 30 | 30 | 30 | 30 |
| Zinc Oxide | 31.5 | 6.0 | 6.0 | 6.0 |
| T. G. Regrind | 16 | 16 | 16 | 16 |
| Zinc Stearate | 16 | 16 | 16 | 16 |
| Zinc diacrylate (ZDA) | 21.5 | 21.5 | 21.5 | 21.5 |
| Tungsten Powder | — | 20 | — | — |
| Bismuth Powder | — | — | 21 | — |
| Molybdenum Powder | — | — | — | 21 |
| Luperco 231 XL peroxide | 0.90 | 0.90 | 0.90 | 0.90 |
| | 185.90 | 180.40 | 181.40 | 181.40 |
| Size (in.) | 1.496 | 1.496 | 1.496 | 1.496 |
| Weight (g.) | 34.6 | 34.4 | 34.3 | 34.3 |
| Riehle Compression | 107 | 116 | 116 | 116 |
| COR (×1000) | 769 | 770 | 767 | 766 |
| COR (×1000) + Riehle Comp. | 876 | 886 | 883 | 882 |

EXAMPLE 2

A set of tungsten-containing golf ball cores was formed and covered with an inner cover layer having a thickness of 0.050 inches, and a composition of 50 parts by weight lotek 1002 and 50 parts by weight lotek 1003. The inner cover layer was subsequently covered with an outer cover layer having a thickness of 0.055 inches, and containing 42 parts by weight lotek 7510, 42 parts by weight lotek 7520, 7.3 parts by weight lotek 7030, 8.7 parts by weight lotek 8000, and a whitener package containing 2.3 parts by weight of Unitane 0–110, 0.025 parts by weight Eastobrite OB1, 0.042 parts by weight Ultramarine Blue, and 0.004 parts by weight Santanox R. The properties of the molded cores, glebared cores and finished balls are shown on Table 2, along with the properties of control balls which have the same type of inner and outer cover as the tungsten-containing balls. The results show that the inclusion of tungsten results in a slightly higher COR even if the ball has a slightly softer compression. It is believed that the COR of the tungsten ball would be even higher if the tungsten-containing ball had the same Riehle compression as the control.

TABLE 2

Tungsten-Containing Golf Balls v. Control

| Core (parts) | Control | Tungsten |
|---|---|---|
| Cariflex | 70 | 70 |
| Taktene | 30 | 30 |
| Zinc oxide | 31.5 | 5.7 |
| T. G. Regrind | 16 | 16 |
| Zinc stearate | 16 | 16 |
| ZDA | 21.5 | 23.0 |
| Tungsten | — | 20.0 |
| | Red | Blue |
| Luperco 231 XL peroxide | 0.90 | 0.90 |
| | 185.90 | 181.60 |
| Molded | | |
| Size (in) | 1.493 | 1.492 |
| Weight (g) | 34.6 | 34.3 |
| Comp (Riehle) | 102 | 106 |
| COR (×1000) | 773 | 779 |

TABLE 2-continued

| Tungsten-Containing Golf Balls v. Control | | |
|---|---|---|
| Core (parts) | Control | Tungsten |
| Glebared | | |
| Size (in) | 1.469 | 1.469 |
| Weight (g) | 32.7 | 32.4 |
| Comp (Riehle) | 102 | 105 |
| COR (×1000) | 771 | 777 |
| Finished ball (avg 2 doz each) | | |
| Size (in) | 1.681 | 1.680 |
| Weight (g) | 45.45 | 45.28 |
| Comp (Riehle) | 82 | 84 |
| COR (×1000) | 786 | 790 |
| Selected for Distance Testing | | |
| Size (in) | 1.681 | 1.680 |
| Weight (g) | 45.38 | 45.33 |
| Comp (Riehle) | 82 | 83 |
| COR (×1000) | 786 | 789 |

EXAMPLE 3

A number of two-layer balls were formed containing tungsten in the core and containing high quantities of titanium in the form of titanium dioxide in the cover layer. The composition and properties of the golf balls are shown below on Table 3.

The invention has been described with reference to the preferred embodiment. Obviously, modifications and alterations will occur to others upon reading and understanding the proceeding detailed description. It is intended that the invention be construed as including all such modifications and alterations insofar as they come within the scope of the appended claims or the equivalents thereof.

TABLE 3

| Titanium-Tungsten Golf Balls | | | |
|---|---|---|---|
| Materials | | PHR | PHR |
| Cariflex 1220 | | 70 | 70 |
| Taktene 220 | | 30 | 30 |
| Zinc Oxide | | 21.91 | 21.91 |
| TG Regrind | | 20 | 20 |
| Zinc Stearate | | 20 | 20 |
| ZDA | | 24 | 24 |
| Tungsten Powder | | 0.35 | 0.35 |
| Disco Red Masterbatch (MB) | | 0.2 | 0 |
| Green MB | | 0 | 0.16 |
| Blue MB | | 0 | 0.16 |
| Luperco 231 XL (perox.) | | 0.9 | 0.9 |
| Core Date | | | |
| Size (in.) | | 1.545 | 1.545 |
| Weight (g.) | | 36.5 | 36.5 |
| Riehle Comp. | | 90 | 90 |
| COR | | 780 | 780 |
| COVER DETAILS | | | |
| Materials | Flex Modulus | PHR | PHR |
| Iotek 1002 (18%, Na) | 380 MPa | 29.73 | 29.73 |
| Iotek 1003 (18%, Zn) | 147 MPa | 55.26 | 55.26 |
| Iotek 7030 (15%, Zn) | 155 MPa | 15.01 | 5.01 |
| Titanium Dioxide | | 4.76 | 4.76 |
| Ultramarine Blue | | 0.0921 | 0.0921 |

TABLE 3-continued

| Titanium-Tungsten Golf Balls | | |
|---|---|---|
| Eastabrite OB-1 | 0.0262 | 0.0262 |
| Santonox R | 0.0076 | 0.0076 |
| Blend Modulus (Wgt Avg) | 217 MPa | 217 MPa |
| Blend % Acid (Wgt Avg) | 17.6% | 17.6% |
| Thickness (in.) | 0.0675 | 0.0675 |
| Shore C/D hardness | 97/71 | 97/71 |
| Ball Data | | |
| Size. (in.) | 1.68 | 1.68 |
| Weight (g.) | 45.5 | 45.5 |
| Riehle Comp. | 76 | 76 |
| COR | 810 | 810 |

What is claimed is:

1. A golf ball, comprising:

a solid core comprising a rubber and 0.1–40 parts by weight of a filler material having a specific gravity of at least 7 based upon 100 parts by weight of the rubber material, and a dimpled cover layer disposed about the core and comprising a resin and at least 3.5 parts by weight of a whitening agent selected from the group consisting of titanium dioxide, barium sulphite, and zinc sulfide white based upon 100 parts by weight of the resin, the golf ball having a coefficient of restitution of at least 0.750.

2. A golf ball according to claim 1, wherein the filler material is tungsten.

3. A golf ball according to claim 1, wherein the filler material is present in an amount of 10–30 parts by weight based upon 100 parts by weight of the rubber material.

4. A golf ball according to claim 2, wherein the tungsten is present in an amount of 17–23 parts by weight based upon 100 parts by weight of the rubber material.

5. A golf ball according to claim 1, wherein the whitening agent is present in an amount of 4–20 parts by weight based upon 100 parts by weight of resin.

6. A golf ball according to claim 2, wherein the whitening agent is present in an amount of 4–20 parts by weight based upon 100 parts by weight of the resin.

7. A golf ball according to claim 1, wherein the whitening agent is titanium dioxide.

8. A golf ball according to claim 2, wherein the whitening agent is titanium dioxide.

9. A golf ball according to claim 4, wherein the whitening agent is titanium dioxide.

10. A golf ball according to claim 6, wherein the whitening agent is titanium dioxide.

11. A golf ball according to claim 1, wherein the resin comprises ionomer.

12. A golf ball according to claim 2, wherein the resin comprises ionomer.

13. A golf ball according to claim 8, wherein the resin comprises ionomer.

14. A golf ball according to claim 1, further including a layer of windings surrounding the solid core.

15. A golf ball according to claim 1, further including an inner cover layer between the solid core and the dimpled inner layer.

16. A golf ball according to the claim 14, further including an inner cover layer between the layer of windings and the dimpled cover layer.

17. A golf ball, comprising:

a solid core comprising a rubber material and 0.1–40 parts by weight of tungsten based upon 100 parts by weight of the rubber material, and a dimpled cover layer disposed on the solid core, the cover comprising a resin composition which includes ionomer, the cover layer further including 3.5–20 parts by weight of titanium dioxide based upon 100 parts by weight of the resin composition.

18. A golf ball according to claim 17, wherein the golf ball has a coefficient of restitution of at least 0.750.

19. A golf ball according to claim 17, wherein the ball has a coefficient of restitution of at least 0.780.

20. A golf ball comprising:

a solid core comprising a rubber material and 10–30 parts by weight of at least one member selected from the group consisting of tungsten, bismuth and molybdenum based upon 100 parts by weight of the rubber material, and a dimpled cover layer disposed about the core, the cover layer comprising a resin composition which includes ionomer, the cover layer further including 3.5–20 parts by weight of titanium dioxide based upon 100 parts by weight of the resin composition.

* * * * *

UNITED STATES PATENT AND TRADEMARK OFFICE

CERTIFICATE OF CORRECTION

PATENT NO. : 6,565,457 B1 
DATED : May 20, 2003
INVENTOR(S) : Michael J. Sullivan, R. Dennis Nesbitt and John L. Nealon It is certified that error appears in the above-identified patent and that said Letters Patent is hereby corrected as shown below:

Title page,
Item [75], "Michael J. Sullivan, Ludlow, MA" should read
-- Michael J. Sullivan, Chicopee, MA --.

Signed and Sealed this

Sixteenth Day of September, 2003

JAMES E. ROGAN
*Director of the United States Patent and Trademark Office*